US009475312B2

(12) United States Patent
Kitada et al.

(10) Patent No.: US 9,475,312 B2
(45) Date of Patent: Oct. 25, 2016

(54) INK JET PRINTER AND PRINTING METHOD

(71) Applicant: Seiko Epson Corporation, Tokyo (JP)

(72) Inventors: Kenji Kitada, Matsumoto (JP); Takuya Miyakawa, Matsumoto (JP); Takashi Saiba, Shiojiri (JP); Kiyofumi Kitawada, Chino (JP); Atsushi Denda, Chino (JP); Maki Nariai, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/601,373

(22) Filed: Jan. 21, 2015

(65) Prior Publication Data

US 2015/0202894 A1 Jul. 23, 2015

(30) Foreign Application Priority Data

Jan. 22, 2014 (JP) ..... 2014-009514
Feb. 24, 2014 (JP) ..... 2014-033116
Mar. 28, 2014 (JP) ..... 2014-069910

(51) Int. Cl.
*B41J 11/02* (2006.01)
*B41J 11/00* (2006.01)

(52) U.S. Cl.
CPC ..... *B41J 11/002* (2013.01)

(58) Field of Classification Search
CPC ..... B41J 11/002
USPC ..... 347/102
See application file for complete search history.

(56) References Cited

U.S. PATENT DOCUMENTS 6,158,648 A 12/2000 Mori et al.
6,528,129 B1 * 3/2003 Kondo ..... B41M 5/52 427/535
7,419,257 B2 * 9/2008 Mouri ..... B41J 2/0057 347/102
2004/0161678 A1 8/2004 Misaka
2009/0207224 A1 * 8/2009 Cofler ..... B41J 3/28 347/102
2009/0290007 A1 11/2009 Saitoh et al.
2010/0151231 A1 * 6/2010 Matsuo ..... B29C 59/14 428/336
2013/0250017 A1 * 9/2013 Saitoh ..... C08J 7/00 347/101

FOREIGN PATENT DOCUMENTS

JP 62-223384 10/1987
JP 07-245192 9/1995
JP 09-092493 4/1997

(Continued)

OTHER PUBLICATIONS

Hisato Kato et al., "Inkjet Printing System for Textiles", (2010), vol. 7, Japan (Abstract, Figures and Table in English).

*Primary Examiner* — Julian Huffman
*Assistant Examiner* — Michael Konczal
(74) *Attorney, Agent, or Firm* — Harness, Dickey & Pierce, P.L.C.

(57) ABSTRACT

An ink jet printer includes a transport mechanism that transports a medium in a first direction; and a carriage that includes a plasma irradiation mechanism, which emits plasma generated in a discharge portion from a plasma irradiation port and then irradiates at least a part of the medium with the plasma, and a head which ejects ink onto the part of the medium which is irradiated with the plasma, and that moves in a second direction intersecting with the first direction, in which the plasma irradiation mechanism is provided on one side of the head in the second direction, and the discharge portion of the plasma irradiation mechanism is disposed so as not to come in contact with the medium.

16 Claims, 5 Drawing Sheets

(56) References Cited

FOREIGN PATENT DOCUMENTS

| | | | |
|---|---|---|---|
| JP | 09-237773 | | 9/1997 |
| JP | 09-298189 | | 11/1997 |
| JP | 2005-044565 | A | 2/2005 |
| JP | 2006-336175 | A | 12/2006 |
| JP | 2007-018005 | A | 1/2007 |
| JP | 2008-091723 | A | 4/2008 |
| JP | 2009-279796 | A | 12/2009 |
| JP | 2010-141194 | A | 6/2010 |
| JP | 2010-147140 | A | 7/2010 |
| JP | 2012-179747 | A | 9/2012 |
| JP | 2012-179748 | A | 9/2012 |
| JP | 05-247859 | B2 | 7/2013 |

* cited by examiner

INK JET PRINTER AND PRINTING METHOD

BACKGROUND

1. Technical Field

The present invention relates to an ink jet printer and a printing method.

2. Related Art

In the related art, a printing method using an ink jet printer is performed by causing small ink droplets to be scattered and then attached onto a medium such as paper. Recently, according to innovative advancement in ink jet printing technology, printing has been performed on a medium formed of fabric such as silk, polyester, and cotton which have high absorbency of ink, and a plastic-based medium which does not absorb ink by the ink jet printer.

When performing the printing on the plastic-based medium by the ink jet printer, a technique of improving a surface of the medium which is modified by being irradiated with the plasma, thus increasing the affinity between the medium and ink (for example, refer to JP-A-2009-279796, JP-A-2012-179748, and JP-A-2012-179747) has been known.

JP-A-2009-279796, and JP-A-2012-179748 disclose a plasma irradiation mechanism which is provided separately from a carriage. The plasma irradiation mechanism disclosed in JP-A-2009-279796 and JP-A-2012-179748 is provided with a pair of electrodes which interposes a medium therebetween and performs a surface treatment by causing the plasma generated between these electrodes to come in contact with the medium.

JP-A-2012-179747 discloses a plasma irradiation mechanism which is a plasma irradiation mechanism mounted in a carriage and is disposed so as to be along the direction orthogonal to the travelling direction of the carriage (for example, refer to a paragraph [0012]). The plasma irradiation mechanism disclosed in JP-A-2012-179747 performs the surface treatment by causing the plasma, which is generated between a pair of electrodes (4 and 5) disposed on the same side with respect to a medium, to come in contact with the medium (for example, refer to paragraph [0015]).

As described above, in JP-A-2009-279796, JP-A-2012-179748, and JP-A-2012-179747, the surface treatment is performed through a so called direct method of causing a discharge portion to directly come in contact with a medium. The direct method is a method of performing the surface treatment on a target to be processed by generating the plasma in a state where the target to be processed is disposed between electrodes.

However, in the surface treatment performed through the direct method, since a discharge portion directly comes in contact with the medium, the medium is likely to be damaged or discolored.

SUMMARY

An advantage of some aspects of the invention is to provide an ink jet printer and a printing method which are capable of suppressing at least one of damage and discoloration of a medium when performing surface modification of the medium by plasma irradiation.

According to a first aspect of the invention, there is provided an ink jet printer including a transport mechanism that transports a medium in a first direction and a carriage that includes a plasma irradiation mechanism, which emits plasma generated in a discharge portion from a plasma irradiation port and then irradiates at least a part of the medium with the plasma, and a head which ejects ink to the part of the medium which is irradiated with the plasma, and that moves in a second direction intersecting with the first direction. The plasma irradiation mechanism is provided on one side of the head in the second direction. The discharge portion of the plasma irradiation mechanism is disposed so as not to come in contact with the medium.

According to a second aspect of the invention, there is provided an ink jet printer including a transport mechanism that transports a medium in a first direction and a carriage that includes a plasma irradiation mechanism, which emits plasma generated in a discharge portion from a plasma irradiation port and then irradiates at least a part of the medium with the plasma, and a head which ejects ink to the part of the medium which is irradiated with the plasma, and that moves in a second direction intersecting with the first direction. The plasma irradiation mechanism is provided on both sides of the head in the second direction. The discharge portion of the plasma irradiation mechanism is disposed so as not to come in contact with the medium.

According to a third aspect of the invention, there is provided a printing method of performing printing on a medium which is transported in a first direction by using a carriage which includes a plasma irradiation mechanism emitting plasma and a head ejecting ink. The method includes emitting the plasma, which is generated in a discharge portion of the plasma irradiation mechanism, from a plasma irradiation port so as to irradiate at least a part of the medium with the plasma and ejecting ink from the head to the part of the medium which is irradiated with the plasma. In the emitting of the plasma and the ejecting of the ink, the printing is performed by transporting the carriage in a second direction intersecting with the first direction. In the emitting of the plasma, due to the plasma irradiation mechanism which is provided on one side of the head in the second direction, the plasma is emitted in a state where the discharge portion does not come in contact with the medium.

According to a fourth aspect of the invention, there is a provided a printing method of performing printing on a medium which is transported in a first direction by using a carriage which includes a plasma irradiation mechanism emitting plasma and a head ejecting ink. The method includes transporting the medium in the first direction, emitting the plasma, which is generated in a discharge portion of the plasma irradiation mechanism, from a plasma irradiation port so as to irradiate at least a part of the medium with the plasma and ejecting ink from the head to the part of the medium which is irradiated with the plasma. In the emitting of the plasma and the ejecting of the ink, the printing is performed by transporting the carriage in a second direction intersecting with the first direction. In the emitting of the plasma, due to the plasma irradiation mechanism which is provided on both sides of the head in the second direction, the plasma is emitted in a state where the discharge portion does not come in contact with the medium.

It is preferable that a distance between the medium and the plasma irradiation port of the plasma irradiation mechanism is 1 mm or more and 20 mm or less.

It is preferable that the distance between the medium and the plasma irradiation port of the plasma irradiation mechanism is 3 mm or more and 7 mm or less.

It is preferable that one portion on the medium is irradiated with the plasma at least twice before the ink is attached to the medium.

BRIEF DESCRIPTION OF THE DRAWING

The invention will be described with reference to the accompanying drawing, wherein like numbers reference like elements.

DESCRIPTION OF EXEMPLARY EMBODIMENTS

First Embodiment

Figure 1:
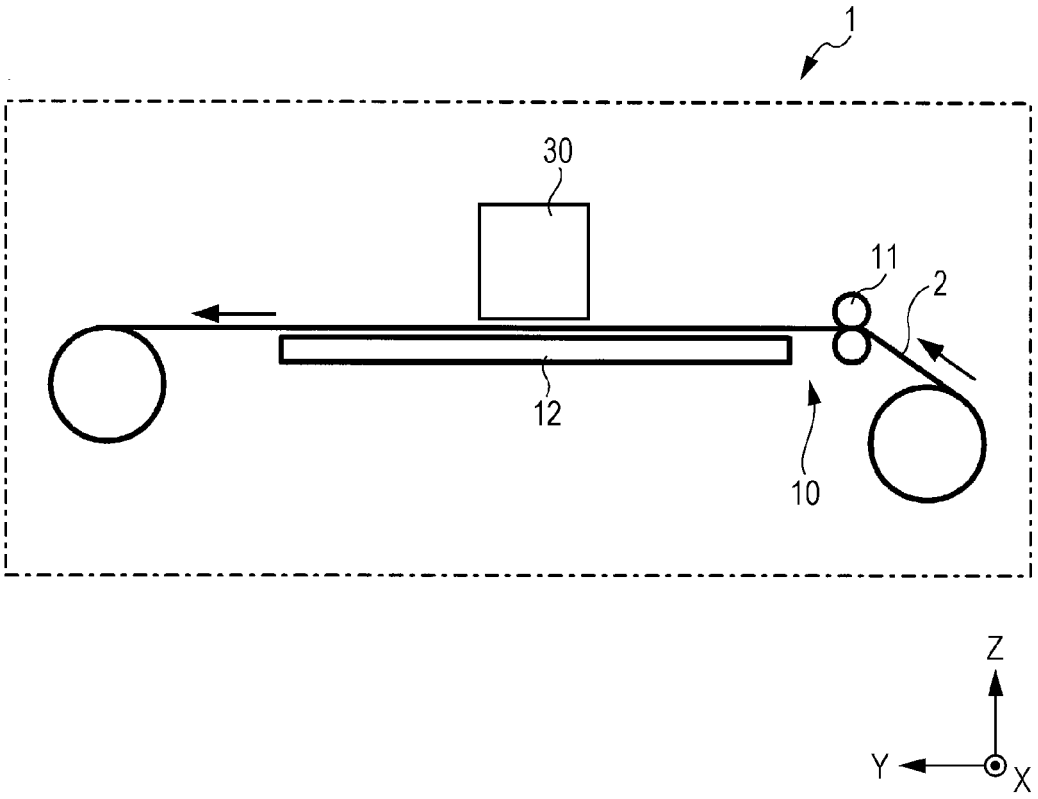
FIG. 1 is a diagram schematically illustrating an ink jet printer according to the first embodiment.

Hereinafter, embodiments of the invention will be described in detail. It should be noted that the invention is not limited to the following embodiments, and can include various types of modifications which are carried out within the scope of the invention. In the following description, three directions which are orthogonal to each other are respectively referred to as an X direction, a Y direction, and a Z direction. In addition, the Z direction is a vertical direction, and the Y direction is a direction in which the medium is transported. The upper side of the vertical direction is a +Z direction, and the lower side thereof is a −Z direction. Three directions corresponding to these directions are illustrated in the drawings as well. Ink jet printer FIG. 1 is a diagram schematically illustrating an ink jet printer according to the embodiment. The ink jet printer 1 includes a transport mechanism 10 which transports a medium 2 in the Y direction (the first direction), and a carriage 30 which moves in the X direction (the second direction) intersecting with the Y direction to perform the printing on the medium 2.

The ink jet printer 1 according to the embodiment includes a control unit (not shown) controlling all of the operations of the ink jet printer. The control unit is provided at a certain position of the ink jet printer 1 and controls the operation of each unit of the ink jet printer based on information which is input from an input unit, for example, a PC or a touch panel.

The transport mechanism 10 includes, for example, a roller 11 and a platen 12. Meanwhile, positions and the number of the rollers 11 are not limited. The platen 12 supports the medium 2 from a surface on the side opposite to a surface of the medium 2 on which the image is printed. A heater may be built in the platen 12.

Although not shown in the drawings, a drying mechanism for drying a solvent of ink may be provided on the rear side of the carriage 30 in the transporting direction of the medium 2. Examples of the drying mechanism are, for example, the heater, or an air blowing mechanism.

As will be described below, since ink type is not particularly limited, various additional mechanisms may be provided according to the ink type. For example, in a case where the ink is an ultraviolet ray curable ink, the ultraviolet ray irradiation mechanism is provided on the rear side of the carriage 30 in the transporting direction of the medium 2. In addition, if the medium 2 is the fabric, a mechanism for applying a pretreatment liquid for fixing the ink on the fabric may be provided on the front side of the carriage 30 in the transporting direction of the medium. In this manner, various additional mechanisms in addition to the carriage can be provided according to the types of the medium and the ink.

Figure 2:
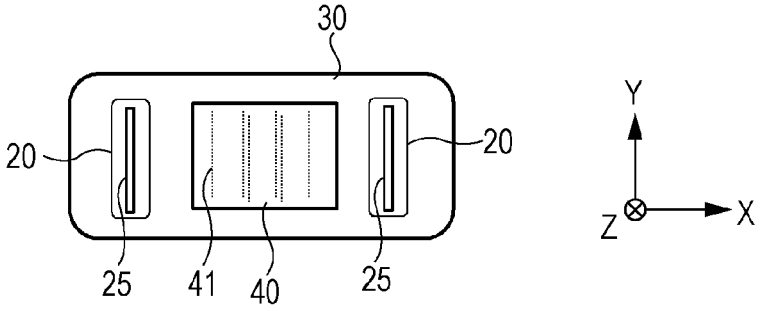
FIG. 2 is a bottom view schematically illustrating a configuration of a carriage.

FIG. 2 is a bottom view schematically illustrating a configuration of the carriage 30.

As illustrated in FIG. 2, the carriage 30 includes a plasma irradiation mechanism 20 which emits plasma generated in a discharge portion from a plasma irradiation port and then irradiates at least a part of the medium with the plasma, and a head 40 which ejects ink to a part of the medium which is irradiated with the plasma.

The plasma irradiation mechanism 20 is provided on both sides of the head 40 in the X direction (in the +X direction and the −X direction). Each of the plasma irradiation mechanisms 20 is, for example, a line-type plasma irradiation mechanism. The plasma irradiation mechanisms are divided into a spot type (may be referred to as a jet type) and a line type depending on the shape of a plasma irradiation port. The line-type plasma irradiation mechanism 20 which extends in the Y direction is used in the embodiment. The amount of plasma irradiation with respect to the medium 2 in the Y direction can be made to be uniform by using the line-type plasma irradiation mechanism. When the amount of plasma irradiation with respect to the medium 2 in the Y direction is non-uniform, banding unevenness is likely to be generated. The banding unevenness means a striped pattern caused by unevenness of ink attachment. When the amount of plasma irradiation is non-uniform, wettability of the medium becomes non-uniform, and as a result, the banding unevenness is generated. In the embodiment, the amount of plasma irradiation with respect to the medium 2 in the Y direction can be uniform, and thus it is possible to suppress the generation of the banding unevenness.

The head 40 is a unit that forms an image by attaching ink droplets on the surface of the medium 2. The head 40 is provided with a plurality of nozzle rows is configured to have a plurality of nozzles 41 which eject the ink. One nozzle row is configured to have the plurality of nozzles 41 which are lined up in the direction (the Y direction) intersecting with the movement direction of the carriage (the X direction). The plurality of nozzle rows are disposed by being lined up in the movement direction of the carriage (the X direction). For example, the ink of the same composition is ejected from one nozzle row.

Methods of ejecting the ink from the nozzle 41 of the head 40 are, for example, as follows. Specifically, there are a method of recording an information signal by applying an intense electric field between the nozzle and an acceleration electrode placed on the front side of the nozzle, continuously ejecting the ink droplet from the nozzle, and then imparting the information signal to a deflecting electrode while the ink droplets are scattered between the deflecting electrodes, or a method of ejecting the ink droplets in response to the recorded information signal without deflecting the ink droplets (an electrostatic suction type), a method of forcibly ejecting the ink droplets by applying pressure to the ink by using a small pump and mechanically vibrating the nozzle by using a quartz resonator or the like, and a method of ejecting and recording the ink droplets by applying the pressure and the recorded information signal to the ink at the same time by using a piezoelectric element (a piezo type), and a method of ejecting and recording the ink droplets by heating the ink to be foamed by using a fine electrode in accordance with the recorded information signal (a thermal jet ejection type).

The head 40 is a so called serial-type recording head. The serial-type recording head performs the printing of an image by performing scanning (pass), in which the recording head is moved in the direction intersecting with respect to the transporting direction of the medium to eject the ink, several times. Because of this, the ink jet printer according to the embodiment is a so called serial printer.

Figure 3:
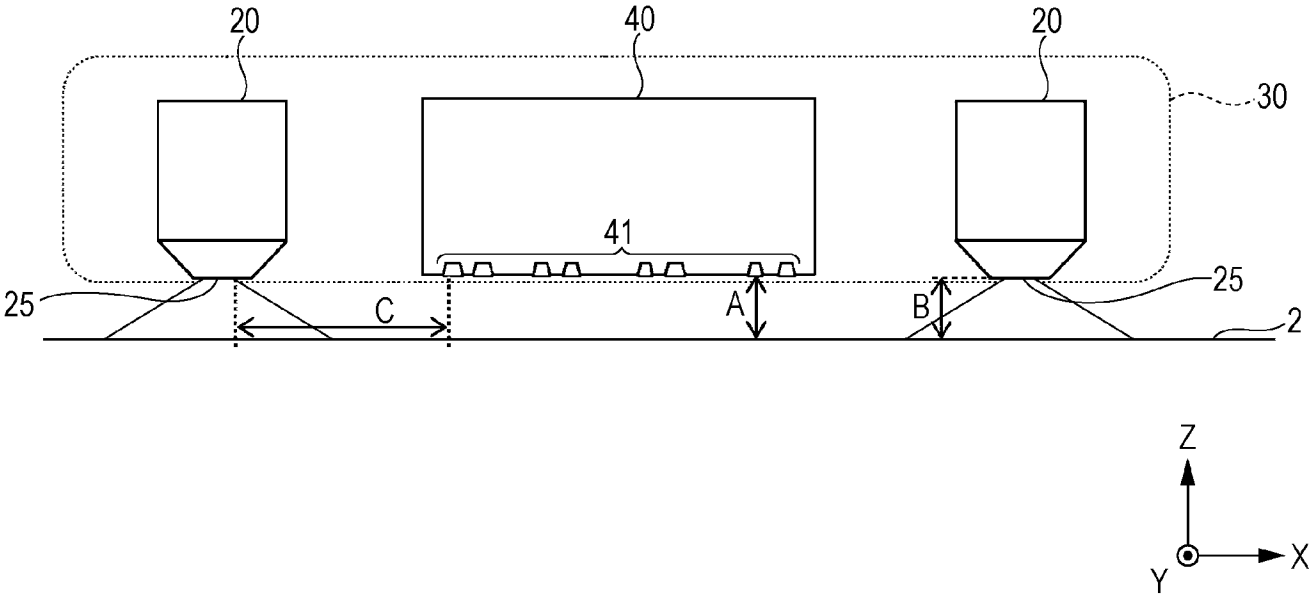
FIG. 3 is a side view schematically illustrating the configuration of the carriage.

FIG. 3 is a side view schematically illustrating the configuration of the carriage.

As illustrated in FIG. 3, when performing the printing, the carriage 30 is disposed in proximity with respect to the medium 2. A plasma irradiation port 25 of the plasma irradiation mechanism 20 and the nozzle 41 of the head 40 are disposed to face the medium 2. A distance (A) between the medium 2 and the nozzle 41 is not limited; however the distance is, for example, several mm. In addition, a distance (C) between the head 40 (more specifically, the nozzle 41 disposed on an outer edge) and the plasma irradiation port 25 is not limited; however the distance is, for example, several tens of mm.

The plasma irradiation mechanism 20 is a so called remote method plasma irradiation mechanism in which at least a part of the medium 2 is irradiated with the plasma generated in the discharge portion which is emitted from the plasma irradiation port 25. Plasma irradiation mechanisms using atmospheric pressure plasma use two methods; a direct method and a remote method. The direct method is for emitting the plasma which is generated between electrodes in a state where the discharge portion directly comes in contact with a substrate, here, the state where the discharge portion directly coming in contact with the substrate means, for example, is a process of the plasma performed by disposing a target to be processed (the medium according to the embodiment) between electrodes. The remote method is for processing the plasma which is generated between the electrodes by being sprayed onto the target to be processed. In a case of employing the direct method, since the medium 2 is exposed to the discharge portion (a discharge region) between electrodes, there is a disadvantage in that the medium 2 is damaged. Since the embodiment employs the remote method, the medium 2 is not exposed to the discharge portion of the plasma irradiation mechanism 20 and thus it is possible to suppress the damage to or the discoloration of the medium, thereby improving the printing quality.

In the embodiment, a distance (B) between the medium 2 and the plasma irradiation port 25 of the plasma irradiation mechanism 20 is preferably 1 mm or more and 20 mm or less, and is more preferably 3 mm or more and 7 mm or less. When the value of the distance (B) is too small, the plasma irradiation port 25 comes in contact with the medium, and thus the paper jam is generated in some cases. In addition, the discharge portion of the plasma irradiation mechanism 20 comes in contact with the medium 2, and thus the medium 2 is highly probably discolored by discharge damage. On the other hand, if the value of the distance (B) is too large, the plasma does not easily act on the medium 2, and thus a surface modifying effect may not be sufficiently obtained.

Figure 4:
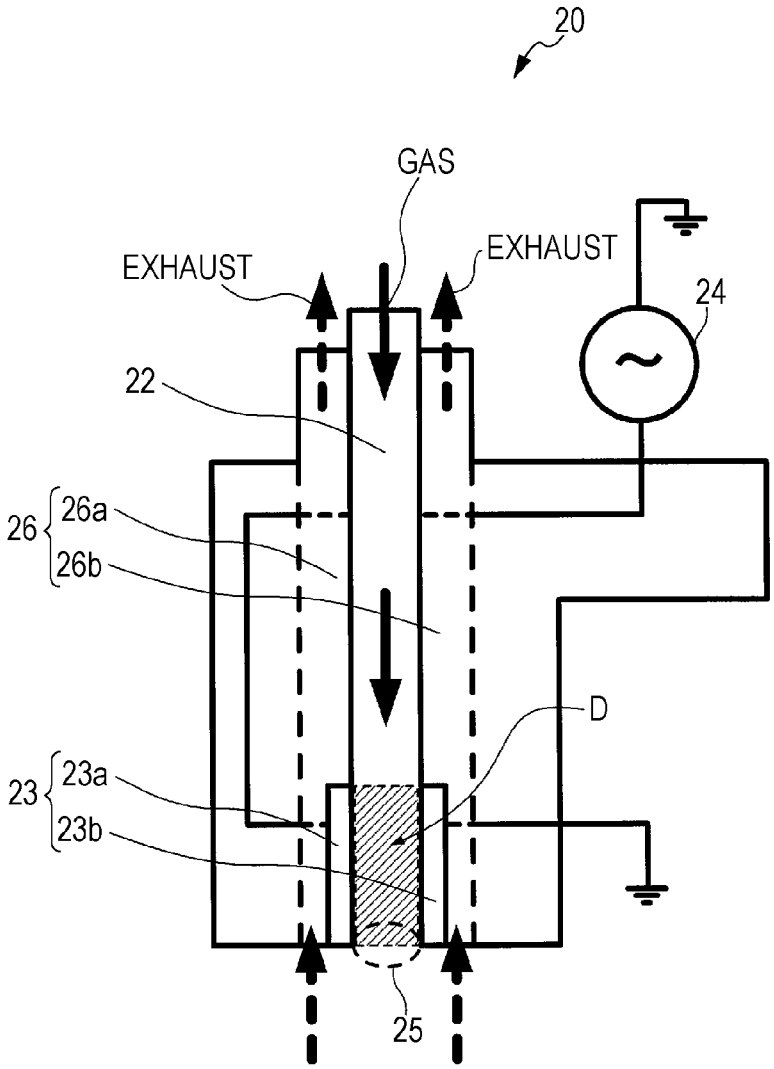
FIG. 4 is a diagram schematically illustrating a cross section of a plasma irradiation mechanism.

FIG. 4 is a diagram schematically illustrating a cross section of the plasma irradiation mechanism 20. The plasma irradiation mechanism 20 is provided with a gas supply chamber 22 which is connected to a gas storage portion (not shown), an electrode pair 23 which is provided to face at least a part of the gas supply chamber 22, a power source 24, the plasma irradiation port 25, and an exhaust pipe 26.

The gas supply chamber 22 is connected to a gas storage portion 29 through a gas supply pipe (not shown), and the gas stored in the gas storage portion 29 can flow therein. The electrode pair 23 is provided at an arbitrary position of the gas supply chamber 22. The electrode pair is provided with an electrode 23*a* and an electrode 23*b* which are installed so as to face each other. In order to apply the voltage to the electrode 23*a* and the electrode 23*b*, the power source 24 is connected thereto.

The plasma irradiation port 25 is provided at a tip end of the gas supply chamber 22 facing the medium 2. The plasma irradiation port 25 is a nozzle hole for emitting the plasma which is generated by passing through a region between the electrode 23*a* and the electrode 23*b*. The region between the electrode 23*a* and the electrode 23*b* corresponds to a discharge portion D (the discharge region).

The exhaust pipe 26 is installed to perform the plasma irradiation by absorbing and discharging excess gas and adjust a range of the plasma irradiation which is radiated from the plasma irradiation port 25, and thus locally process a desired range. An installment position of the exhaust pipe 26 is not particularly limited but, for example, in an example illustrated in FIG. 4, the exhaust pipe 26 is provided with an exhaust pipe 26*a* and an exhaust pipe 26*b* which are provided along the gas supply chamber 22.

When the voltage is applied to the electrode 23*a* and the electrode 23*b* through the power source 24, a discharge is generated between the electrode 23*a* and the electrode 23*b* (the "discharge portion D"). In this state where the discharge is generated, the gas is supplied to the gas supply chamber 22, and the gas passes through between the electrode 23*a* and the electrode 23*b*, thereby generating the plasma of the gas (that is, at least a part of the gas is turned into plasma). The plasma generated in this manner is emitted from the plasma irradiation port 25, and the surface of the medium 2 is irradiated with the plasma. That is, the surface of the medium 2 is irradiated with the plasma generated in the discharge portion D in a state where the discharge portion D does not come in contact with the medium 2. In other words, the medium 2 does not pass through the discharge portion D and thus does not directly come in contact with the discharge portion D. Such a plasma generation mechanism is referred to as using the remote method as described above.

In this manner, it is possible to suppress the discoloration of the medium by using the remote-type plasma irradiation mechanism which does not cause the medium to come in contact with the discharge portion, and thus texture and color of the medium can be maintained. Particularly, in the case of using a medium having high whiteness, the effect is more exaggerated.

The plasma irradiation mechanism 20 preferably includes a mechanism for generating and emitting the plasma under the atmospheric pressure. In the case of generating the plasma under the atmospheric pressure, since there is no need to provide a pressure reducing mechanism in the plasma irradiation mechanism, the reduction in size of an apparatus can be realized, and thus there is an advantage of performing the plasma irradiation in a line (that is, a process of the plasma irradiation, the ink ejection, or the like can be continuously performed). Here, the pressure at the time of generating the plasma corresponds to the pressure in the gas supply chamber 22 at the time of generating the plasma.

The amount of electric power used at the time of generating the plasma is not particularly limited as long as the plasma can be generated from the supplied gas, for example, and the amount can be set within a range of 20 Wh to 200 Wh.

The frequency of the power source 24 at the time of generating the plasma is not particularly limited as long as the plasma can be generated from the supplied gas, for example, and the frequency can be set within a range of 50 Hz to 30 MHz. Meanwhile, the power source 24 may be a DC power source.

One type of gas may be supplied or a mixed gas may be obtained by mixing two or more types of gases and may be supplied to the gas supply chamber 22. As a raw material of the gas, for example, oxygen ($O_2$), nitrogen ($N_2$), the air (including at least nitrogen ($N_2$) and oxygen ($O_2$)), water vapor ($H_2O$), nitrous oxide ($N_2O$), ammonia ($NH_3$), argon (Ar), helium (He), and neon (Ne) are included. Meanwhile, a gas flow amount supplied to the gas supply chamber 22 can be properly set according to capacity of the gas supply chamber 22, a gas type, a medium type, and the printing rate or the like, and there is no particular limitation thereto.

For example, it is possible to impart a hydroxy group to the surface of the medium 2 due to the plasma derived from the oxide gas by supplying the oxide gas to the gas supply chamber 22. In addition, in the case of including an oxygen atom in a structure skeleton of the medium, the plasma derived from the inert gas can cut off the combination of oxygen included in the medium 2 by using an inert gas as the gas supplied to the gas supply chamber 22, therefore, it is possible to generate the hydroxy group on the surface of the medium.

Ink

The composition of the ink is not particularly limited; hereinafter, an additive agent (components), which is included in the ink or can be included in the ink, will be described.

The ink may contain a coloring material. The coloring material is selected from a pigment and a dye.

Pigment

It is possible to improve the light resistance of the ink by using the pigment as the coloring material. Both an inorganic pigment and an organic pigment can be used as the pigment.

The inorganic pigment is not particularly limited; however, examples thereof include, for example, carbon black, iron oxide, titanium oxide, and silica oxide. The inorganic pigment may be used as one type individually or may be used in a combination of two or more types.

The organic pigment is not particularly; however, examples thereof include, for example, a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolo-pyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, and an azo-based pigment. As specific organic pigments, the following can be exemplified.

The pigment used for a black ink is not particularly limited; however, examples thereof include a carbon black. The carbon black is not particularly limited; however, examples thereof include a furnace black, a lamp black, an acetylene black, and a channel black (C. I. pigment black 7). In addition, commercially available products of the carbon black are not particularly limited; however, examples thereof include No. 2300, 900, MCF88, No. 20B, No. 33, No. 40, No. 45, No. 52, MA7, MA8, MA100, and No. 2200B (hereinbefore, all trade names, manufactured by Mitsubishi Chemical Corporation), color blacks FW1, FW2, FW2V, FW18, FW200, 5150, 5160, and 5170, Printex 35, Printex U, Printex V, and Printex 140U, special blacks 6, 5, 4A, 4, and 250 (hereinbefore, all trade names, manufactured by Degussa AG), Conductex SC, RAVEN 1255, RAVEN 5750, RAVEN 5250, RAVEN 5000, RAVEN 3500, and RAVEN 700 (hereinbefore, all trade names, manufactured by Columbian Carbon Japan Ltd), Regal 400R, Regal 330R, and Regal 660R, Mogul L, Monarch 700, Monarch 800, Monarch 880, Monarch 900, Monarch 1000, Monarch 1100, Monarch 1300, and Monarch 1400, and Elftex 12 (hereinbefore, all trade names, manufactured by Cabot Corporation).

Examples of the pigment used for a cyan ink include C. I. Pigment Blues 1, 2, 3, 15, 15:1, 15:2, 15:3, 15:4, 15:6, 15:34, 16, 18, 22, 60, 65, and 66, and C. I. Vat Blues 4 and 60. Among these, at least one of the C. I. Pigment Blues 15:3 and 15:4 is preferable.

Examples of the pigment used for a magenta ink include C. I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:4, 57, 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C. I. Pigment Violets 19, 23, 32, 33, 36, 38, 43, and 50. Among these, it is preferable to use one or more selected from a group consisting of the C. I. Pigment Red 122, the C. I. Pigment Red 202, and the C. I. Pigment Violet 19.

Examples of the pigment used for a yellow ink include C. I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among these, it is preferable to use one or more selected from a group consisting of the C. I. Pigment Yellows 74, 155, and 213.

In addition, as the pigments used for color inks such as green ink, orange ink, and the like, except for the above color inks, commonly known pigments are used.

Dye

A dye may be used as the coloring material. The dye is not particularly limited; however, examples thereof include an acid dye, a direct dye, a reactive dye, and a basic dye.

The content of the coloring material is preferably 0.4% by mass to 12% by mass, and is more preferably 2% by mass to 5% by mass with respect to the total mass (100% by mass) of the ink.

Resin

The ink may contain a resin. The ink contains a resin in order to form a resin coating film on the medium, and thus the ink is sufficiently fixed onto the medium, thereby mainly exhibiting the effect of improving the scratch resistance of an image.

The resin may be any one of an anionic resin, a nonionic resin, and a cationic resin. Among these, the anionic resin or the nonionic resin is preferable from the point of view of a material which is suitable for the head.

The resin may be used as one type individually or may be used in a combination of two or more types.

In addition, examples of the resin which may be included in the ink include a resin dispersant, a resin emulsion, and wax.

Resin Dispersant

In the case of containing the pigment in the ink according to the embodiment, the ink may contain the resin dispersant so that the pigment is able to be dispersed and held in water in a stable manner. The ink includes a pigment (Hereinafter, referred to as a "resin dispersed pigment") which is dispersed by using the resin dispersant such as a water-soluble resin, a water-dispersible resin, or the like, and thus it is possible to improve at least one of the adhesion between the medium and the ink and the adhesion between solidified materials in the ink when the ink is attached to the medium. Among the resin dispersants, the aqueous resin is excellent in dispersion stability and thus is preferably employed.

The resin dispersant may be used as one type individually or may be used in a combination of two or more types.

An additional amount of the resin dispersant among the resins with respect to the pigment is preferably 1 parts by weight to 100 parts by weight, and is more preferably 5 parts by weight to 50 parts by weight with respect to 100 parts by weight of the pigment. When the additional amount is within the above described range, it is possible to secure excellent dispersion stability of the pigment in the water.

Resin Emulsion

The ink may contain the resin emulsion. The resin emulsion forms the resin coating film, and thus the ink is sufficiently fixed onto the medium, thereby exhibiting the effect of improving the adhesion and the scratch resistance of an image.

In addition, the resin emulsion which functions as a binder is included in the ink in an emulsion state. The viscosity of the ink is easily adjusted to be in a proper range in an ink jet recording method by containing the resin which functions as a binder in the ink in the emulsion state, and thus the storage stability and the ejection stability of the ink are improved.

The resin emulsion is not limited to the following; however, examples thereof include homopolymers or copolymers of (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and a vinylidene chloride, a fluorocarbon resin, and a natural resin. Specifically, at least one of (meth)acrylic resin and styrene-(meth)acrylic acid copolymer-based resin is preferable, at least one of acrylic resin and the styrene-acrylic acid copolymer-based resin is more preferable, and the styrene-acrylic acid copolymer-based resin is even more preferable. Note that the above described copolymer may be any one of a random copolymer, a block copolymer, an alternating copolymer, and a graft copolymer.

The resin emulsion may be prepared by using commercially available products can be employed as the resin emulsion and the resin emulsion may be prepared through an emulsion polymerization method as follows. An example of a method of obtaining a thermoplastic resin in the ink in the emulsion state includes a method of emulsion polymerizing a monomer in the water-soluble resin in the water in which a polymerization catalyst and an emulsifier are present. A polymerization initiator, an emulsifier, and a molecular weight regulator which are used when the emulsion polymerization is performed can be used based on the commonly known method.

The average particle diameter of the resin emulsion is preferably in a range of 5 nm to 400 nm and is more preferably in a range of 20 nm to 300 nm so as to enhance the storage stability and the ejection stability of the ink.

The average particle diameter in the specification is an average particle diameter of a volume standard unless otherwise specified. A measuring method is as follows. The particle size distribution of the volume standard is obtained by detecting a pattern of light intensity distribution of diffraction scattering light by using a laser diffraction particle size analyzer, and calculating the pattern of light intensity distribution based on the Mie scattering theory. The volume average particle diameter which is calculated from the particle size distribution can be calculated. An example of the laser diffraction particle size analyzer includes a MICRO TRAC UPA (manufactured by NIKKISO CO., LTD).

The resin emulsion may be used as one type individually or may be used in a combination of two or more types.

Among the resins, it is preferable that the content of the resin emulsion is within a range of 0.5% by mass to 7% by mass with respect to the total mass (100% by mass) of the ink. When the content is within the above range, the solid concentration can be made lower, and thus it is possible to enhance the ejection stability.

Surfactant

The ink may contain a surfactant. The surfactant is not particularly limited; however, examples thereof include an acetylene glycol-based surfactant, a fluorochemical surfactant, and a silicone-based surfactant. Since the ink contains these surfactants, the storage stability and the ejection stability of the ink become better, and it is possible to perform high-speed printing.

The acetylene glycol-based surfactant is not particularly limited; however, examples thereof include preferably one or more types selected from alkylene oxide adducts of 2,4,7,9-tetramethyl-5-decyne-4,7-diol and 2,4,7,9-tetramethyl-5-decyne-4-ol, 7-diol, and alkylene oxide adducts of 2,4-dimethyl-5-decyne-4-ol and 2,4-dimethyl-5-decyne-4-ol. Commercially available products of the acetylene glycol-based surfactant are not particularly limited; however, examples thereof include Orfin 104 series or E-series surfactants such as Orfin E1010 (trade names, manufactured by Air Products Japan, Inc.), and Surfynol 104, 465, and 61 (trade names, manufactured by Nissin Chemical Industry CO., Ltd). The acetylene glycol-based surfactant may be used as one type individually or may be used in a combination of two or more types.

The fluorine-based surfactant is not particularly limited; however, examples thereof include perfluoroalkyl sulfonates, perfluoroalkyl carboxylates, perfluoroalkyl phosphate esters, perfluoroalkyl ethylene oxide adducts, perfluoroalkyl betaine, and perfluoroalkyl amine oxide compounds. Commercially available products of the fluorine-based surfactant are not particularly limited; however, examples thereof include S-144, and S-145 (manufactured by Asahi Glass Co., Ltd.); FC-170C, FC-430, and FLUORAD FC-4430 (manufactured by Sumitomo 3M Limited); FSO, FSO-100, FSN, FSN-100, and FS-300 (manufactured by Dupont); and FT-250 and 251 (manufactured by Neos Corporation). The fluorochemical surfactant may be used as one type individually or may be used in a combination of two or more types.

Examples of the silicone-based surfactant include a polysiloxane-based compound and polyether modified organosiloxane. Commercially available products of the silicone-based surfactant are not particularly limited; however, examples thereof include, specifically, BYK-306, BYK-307, BYK-333, BYK-341, BYK-345, BYK-346, BYK-347, BYK-348, and BYK-349 (hereinbefore, all trade names, manufactured by BYK Japan KK.), and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (hereinbefore, all trade names, manufactured by Shin-Etsu Chemical Co., Ltd.).

The surfactant may be used as one type individually or may be used in a combination of two or more types.

In order to enhance the storage stability and the ejection stability of the ink, it is preferable that the content of surfactant is within a range of 0.1 mass % to 3 mass % with respect to the total mass (100% by mass) of the ink.

Water

The ink may contain water. Particularly, in a case where the ink is an aqueous ink, water is a medium which is a main component of ink, and is evaporates and scatters when the medium is heated during the ink jet recording.

Examples of the water include, for example, water in which ionic impurities are removed as much as possible such as pure water or ultra-pure water such as ion-exchanged water, ultrafiltration water, reverse osmosis water, or distilled water. In addition, when water which is sterilized by ultraviolet irradiation, hydrogen peroxide addition, or the like is used, it is possible to suppress the generation of mold or bacteria in a case where pigment dispersion or the ink using the pigment dispersion is stored for long periods.

The content of the water is not particularly limited, but may be properly determined, if necessary.

Organic Solvent

The ink may contain a volatile water-soluble organic solvent. The organic solvent is not limited to the following; however, examples thereof include alcohols or glycols such as glycerin, ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butylether, dipropylene glycol mono-n-butylether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol, N,N-dimethylformamide, N,N-dimethylacetamide, 2-pyrrolidone, N-methyl-2-pyrrolidone, 2-oxazolidone, 1,3-dimethyl-2-imidazolidinone, dimethyl sulfoxide, sulfolane, and 1,1,3,3-tetramethylurea.

The organic solvent may be used as one type individually or may be used in a combination of two or more types. The content of the organic solvent is not particularly limited, but may be properly determined if necessary.

pH Control Chemical

The ink may include the pH control chemical. Examples of the pH control chemical include an inorganic alkali such as sodium hydroxide and potassium hydroxide, ammonia, diethanolamine, triethanolamine, triisopropanolamine, morpholine, potassium dihydrogen phosphate, and disodium hydrogen phosphate.

The pH control chemical may be used as one type individually or may be used in a combination of two or more types. The content of the pH control chemical is not particularly limited, but may be properly determined, if necessary.

Other Components

In addition to the above components, the ink can properly contain various additive agents, for example, a dissolution aid, a viscosity modifier, an antioxidant, a preservative, a fungicide, an anti-foaming agent, and a corrosion inhibitor. In addition, in a case where the ink is an ultraviolet ray curable ink, the ink contains, for example, a polymerizable compound and a photoinitiator.

Method of Preparing Ink

The ink can be obtained by mixing the above described components (materials) in an optional order, filtering the components if necessary, and then removing impurities. Here, for the sake of easy handling, it is preferable that the pigments are prepared to be uniformly dispersed in the solvent in advance and then mixed.

As a mixing method of the respective materials, there is a preferably used method of stirring and mixing materials which are sequentially added into a container including a stirring apparatus such as a mechanical stirrer or a magnetic stirrer. As a filtering method, for example, centrifugal filtration or filter filtration can be performed if necessary.

Medium

Examples of the medium (a medium to be recorded) include, for example, a medium having absorbency of ink or which does not absorb ink. Particularly, the invention is widely applied to media having various degrees of absorbency, for example, a medium which does not absorb ink, and therefore into which the ink does not easily permeate and a medium having absorbency into which the ink easily permeates.

The medium having absorbency of ink is not particularly limited; however, the medium such as the fabric which does not absorb ink is particularly preferable. The fabric is not limited to the following; however, examples thereof include, for example, natural fibers or synthetic fibers such as silk, cotton, wool, nylon, polyester, and rayon.

The medium which does not absorb ink is not particularly limited; however, examples thereof include a film or a plate made of a plastic such as polyvinyl chloride, polyethylene, polypropylene, and polyethylene terephthalate (PET), a metal plate such as iron, silver, copper, and aluminum, or a metal plate produced by depositing the aforementioned various metals or a film made of the plastic, and a plate formed of an alloy of stainless steel and brass. In addition, as the medium which does not absorb ink, it is preferable that the medium is not formed of an ink absorbing layer formed of silica particles and alumina particles, or an ink absorbing layer formed of a hydrophilic polymer such as polyvinyl alcohol (PVA) and polyvinyl pyrrolidone (PVP).

Printing method

Figure 5:
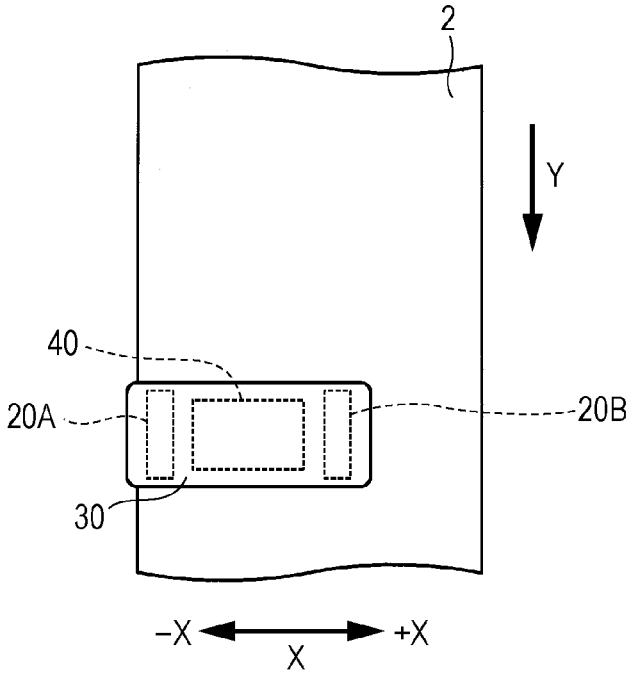
FIG. 5 is a diagram for explaining a printing method according to the first embodiment.

Next, the printing method by using the above described ink jet printer 1 will be described with reference to FIG. 5.

The printing method according to the embodiment is a printing method of performing the printing on the medium 2 transported by the transport mechanism 10 in the Y direction and includes a plasma irradiation process in which a predetermined region of the medium 2 is irradiated with the plasma, and an ink ejection process of ejecting the ink from the head 40 to a part of the medium 2 which is irradiated with the plasma.

The ink jet printer 1 is a serial type, and thus the medium 2 is intermittently transported by the transport mechanism 10. That is, in the state where the medium 2 is at rest, the printing is performed in a predetermined range of the medium 2 while the carriage 30 moves in the X direction, and thereafter an operation, in which the medium 2 is moved to a predetermined position in the Y direction by the transport mechanism 10, is repeatedly performed. That is, the printing is performed on the medium 2 by repeatedly performing a transporting process of the medium and a printing process (the plasma irradiation process and the ink ejection process).

Specifically, in the printing operation performed by the carriage 30, the medium 2 is irradiated with the plasma by the plasma irradiation mechanism 20 while the carriage 30 moves in the X direction, and the ink is ejected from the head 40 to a part of the medium which is irradiated with the plasma.

The medium 2 is irradiated with the plasma and thus the surface of the medium 2 is modified, thereby improving the affinity of the medium 2 with respect to the ink. The affinity of the medium 2 with respect to the ink means hydrophilic properties or water repellency of the medium 2. Particularly, in the embodiment, the plasma irradiation process is performed by the above described plasma irradiation mechanism 20, and thus the discharge portion does not come in contact with the medium 2. Therefore, it is possible to suppress the damage to or the discoloration of the medium 2.

In the embodiment, before the ink is attached to the medium 2, it is preferable that the same part of the medium 2 is irradiated with the plasma at least twice. This is because there is a possibility that the surface modifying effect of the medium cannot be sufficiently obtained by a single case of irradiation. If the irradiation is performed more than twice, the surface modifying effect is more securely obtained. Specifically, dirt on the surface of the medium is removed during the first time, and a functional group derived from gaseous species is imparted to the surface of the medium or a bond of the functional groups on the surface of the medium is split during the second time. In this manner, the surface of the medium 2 is modified.

In a case where the surface of the medium is irradiated with the plasma more than twice before the ink is attached to the surface, for example, the plasma is emitted from the plasma irradiation mechanism 20 in a first reciprocating operation of the carriage 30, and the ink may be ejected from the head 40 by emitting the plasma from the plasma irradiation mechanism if necessary in a second reciprocating operation of the carriage 30. Both of the plasma irradiation mechanisms 20A and 20B (the plasma irradiation mechanism 20) which are provided on both sides of the head 40 may be operated, or either of the plasma irradiation mechanisms 20A or 20B may be operated. For example, in a case where the plasma irradiation mechanisms 20A and 20B on both sides of the head 40 are operated in the first reciprocating operation, it is possible to perform the plasma irradiation twice in the first reciprocating operation. In addition, in a case where the only plasma irradiation mechanism on one side of the head 40 is operated during the first reciprocating operation, the plasma irradiation mechanism 20 on the front side of the head 40 in the travelling direction may be operated in the second reciprocating operation. Specifically, in the case of ejecting the ink by moving the carriage 30 in the +X direction, the plasma irradiation mechanism 20B may be operated in the +X direction during the second reciprocating operation. In addition, in the case of ejecting the ink by moving the carriage 30 in the −X direction, the plasma irradiation mechanism 20B may be operated in the −X direction during the second reciprocating operation. Meanwhile, the carriage 30 may be a single direction printing type for ejecting the ink only when the carriage 30 moves in one of the +X direction and the −X direction, or may be a double direction printing type for ejecting the ink when the carriage 30 moves in both of the +X direction and the −X direction.

After performing the plasma irradiation and the ink ejection on a predetermined range of the medium 2, the medium 2 is transported by the transport mechanism 10 a predetermined distance, and then the plasma irradiation and the ink ejection are performed again on a region adjacent to a predetermined range.

After performing the ink ejection, the solvent which is contained in the ink is dried by a drying mechanism, if necessary. In addition, in a case where the ink is the ultraviolet ray curable ink, the ultraviolet rays are emitted after performing the ink ejection.

According to the ink jet printer and the printing method in the embodiment, since the plasma irradiation is performed without causing the discharge portion of the plasma irradiation mechanism 20 not to come in contact with the medium 2, it is possible to suppress the damage to or the discoloration of the medium, thereby improving the printing quality.

In the plasma irradiation process, when leaving the functional group such as the hydroxy group, which is generated in a predetermined region of the medium, as it is for a certain period of time, a part thereof is separated and thus disappears in some cases. In the embodiment, since the plasma irradiation mechanism 20 is provided on both sides of the head 40 in the movement direction of the head 40, it is possible to shorten the time from the plasma irradiation to the ink ejection. Due to this, it is possible to eject the ink in a state where the surface modifying effect of the medium by the plasma is maintained, thereby improving the printing quality.

In addition, in the embodiment, the distance (B) between the medium 2 and the plasma irradiation port 25 of the plasma irradiation mechanism 20 is preferably 1 mm or more and 20 mm or less, and is more preferably 3 mm or more and 7 mm or less, thereby suppressing the discoloration of the medium 2 by the discharge damage.

Second Embodiment

In the first embodiment, the plasma irradiation mechanism 20 is provided on both sides of the head 40; however, in the second embodiment, the plasma irradiation mechanism 20 is provided on only one side of the head 40. Hereinafter, regarding an ink jet printer and a printing method according to the second embodiment, the description will focus on the differences from the first embodiment. Other points which are not particularly described are the same as in the first embodiment. In addition, in FIGS. 6 and 7, the same constituent elements as in the first embodiment are given the same reference numerals which are used in FIGS. 1 to 5.

Ink Jet Printer

Figure 6:
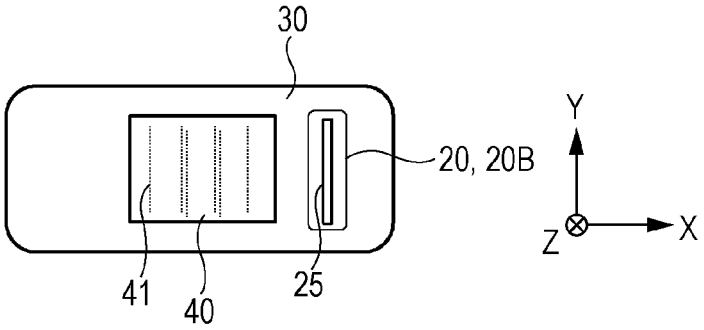
FIG. 6 is a bottom view schematically illustrating a configuration of a carriage in an ink jet printer according to a second embodiment of the invention.

FIG. 6 is a bottom view schematically illustrating the configuration of a carriage 30 in an ink jet printer 1 according to a second embodiment of the invention. As illustrated in FIG. 6, the plasma irradiation mechanism 20 (20B) is provided on one side of the head 40 in the X direction. The plasma irradiation mechanism 20B is, for example, the line-type plasma irradiation mechanism.

Printing Method

Figure 7:
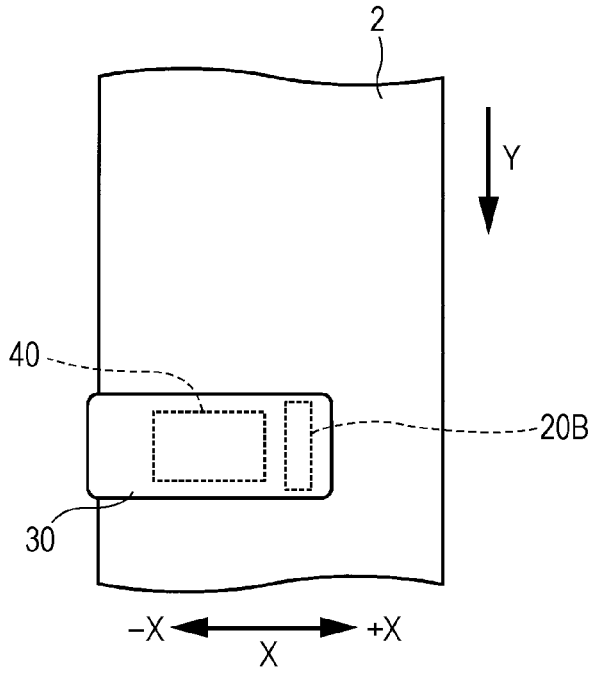
FIG. 7 is a diagram for explaining a printing method using the ink jet printer according to the second embodiment of the invention.

Next, the printing method by using the ink jet printer 1 will be described with reference to FIG. 7.

The embodiment is particularly effective in the case of employing the single direction printing type in which the ink is ejected only when the carriage 30 moves in the +X direction. That is, in the case where the plasma irradiation is performed more than twice before the ink is attached on the surface of the medium, for example, the plasma is emitted from the plasma irradiation mechanism 20B when the carriage 30 moves in the −X direction, and then, the ink may be ejected from the head 40 by emitting the plasma from the plasma irradiation mechanism 20B when the carriage 30 moves in the +X direction.

In this manner, in the case of the single direction printing type in which the ink is ejected only when the carriage 30 moves in the +X direction, it is possible to achieve the same effect as in the first embodiment even when the plasma irradiation mechanism is provided on the only one side of the head 40.

Meanwhile, in the case of the single direction printing type in which the ink is ejected only when the carriage 30 moves in the −X direction, the plasma irradiation mechanism may be provided on the side of the head 40 in the −X direction.

Third Embodiment

In the first and second embodiments, the line-type plasma irradiation mechanism is employed as the plasma irradiation mechanism, while the spot-type plasma irradiation mechanism is employed in the third embodiment. Hereinafter, regarding an ink jet printer and a printing method according to the third embodiment, the description will focus on the differences from the first embodiment. Other points which are not particularly described are the same as in the first embodiment. In addition, in FIG. 8, the same constituent elements as in the first embodiment are given the same reference numerals which are used in FIGS. 1 to 5.

Figure 8:
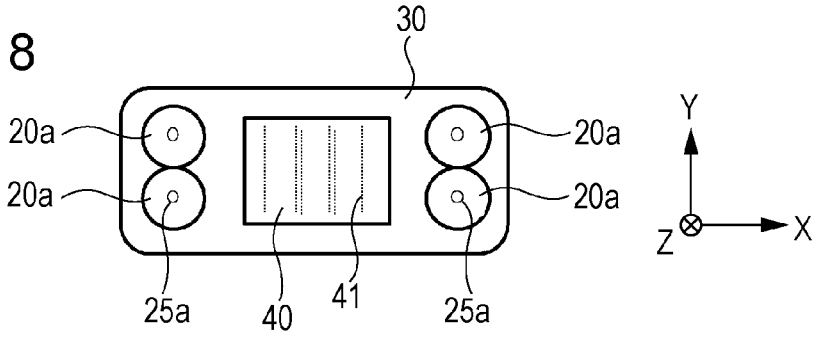
FIG. 8 is a bottom view schematically illustrating a configuration of a carriage in an ink jet printer according to a third embodiment of the invention.

FIG. 8 is a bottom view schematically illustrating the configuration of a carriage 30 in an ink jet printer according to a third embodiment of the invention. As illustrated in FIG. 8, two plasma irradiation mechanisms 20*a* are disposed on one side of the head 40. The two plasma irradiation mechanisms 20*a* are disposed along the transporting direction (Y) of the medium 2. In the embodiment, two spot-type plasma irradiation mechanisms 20*a* are disposed on one side of the head 40; however, three or more spot-type plasma irradiation mechanisms 20*a* may be disposed on one side of the head 40.

The spot-type plasma irradiation mechanism 20*a* has an advantage in that there is a wide selection of the gas used compared with the line-type plasma irradiation mechanism.

Fourth embodiment

The spot-type plasma irradiation mechanism 20 is provided on both sides of the head 40 in the third embodiment, whereas the spot-type plasma irradiation mechanism 20 is provided on only one side of the head 40 in the fourth embodiment. Hereinafter, regarding an ink jet printer and a printing method according to the fourth embodiment, the description will focus on the differences from the third embodiment. Other points which are not particularly described are the same as in the first and third embodiments. In addition, in FIG. 9, the same constituent elements as in the first and third embodiments are given the same reference numerals which are used in FIGS. 1 to 5 and 8.

Figure 9:
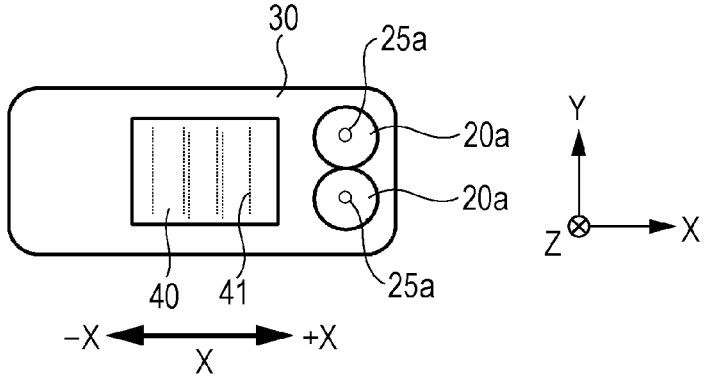
FIG. 9 is a bottom view schematically illustrating a configuration of a carriage in an ink jet printer according to a fourth embodiment of the invention.

FIG. 9 is a bottom view schematically illustrating the configuration of a carriage 30 in an ink jet printer according to a fourth embodiment. As illustrated in FIG. 9, the spot-type plasma irradiation mechanism 20*a* is provided on one side of the head 40 in the X direction.

As described in the second embodiment, in a case of a single direction printing type in which the ink is ejected only when the carriage 30 moves in the +X direction, the plasma irradiation mechanism 20*a* is provided only on the side of the head 40 in the +X direction, and thus it is possible to achieve the same effect as in the third embodiment.

Note that in a case of a single direction printing type in which the ink is ejected only when the carriage 30 moves in the −X direction, the plasma irradiation mechanism may be provided on the side of the head 40 in the −X direction.

EXAMPLES

Hereinafter, the invention will be described in detail based on examples, but is not limited to these examples.

In Examples, the ink jet printer in which the line-type plasma irradiation mechanism 20 is disposed on both sides of the head 40 in the first embodiment is used. Specifically, the line-type plasma irradiation mechanism is equipped in the carriage by modifying a portion of PX-H10000 (manufactured by Seiko Epson Corporation). The distance (A) between the medium 2 and the nozzle 41 illustrated in FIG. 3 is set to 3 mm, and the distance (C) between the head 40 (more specifically, the nozzle 41 disposed in the outer edge) and the plasma irradiation port 25 is set to 50 mm. Then, the distance (B) between the medium 2 and the plasma irradiation port 25 of the plasma irradiation mechanism 20 is changed in order to evaluate the degree of damage and the printing quality with respect to the medium 2. As the gas of a plasma source, nitrogen ($N_2$), oxygen ($O_2$), and argon (Ar) are used.

The printing is performed on the medium by using the aforementioned ink jet printer under the conditions shown in Table 1. Then, regarding the medium and the image on which the printing is performed, the evaluation described below is performed. In Table 1, Comparative Example 1 is an example in which the printing is performed without emitting the plasma. Comparative Example 2 is an example in which the printing is performed by using an apparatus different from that in Examples 1 to 16 through the method disclosed in JP-A-2012-179747. That is, the ink is ejected by pressing a roller-electrode to the medium and emitting the plasma from the direct type.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Formation of plasma | | Line type | Line type | Line type | Line type | Spot type | Line type | Line type | Line type | Line type |
| Apparatus | (B) mm | 1 | 3 | 7 | 20 | 4 | 4 | 4 | 4 | 4 |
| Plasma source | $N_2$ | 97 | 97 | 97 | 97 | 97 | 97 | 100 | 90 | — |
| | $O_2$ | 3 | 3 | 3 | 3 | 3 | 3 | — | 10 | — |
| | Ar | — | — | — | — | — | — | — | — | 100 |
| Number of plasma irradiation | | 2 | 2 | 2 | 2 | 2 | 2 | 2 | 2 | 2 |
| Banding unevenness | | A | A | A | A | B | A | A | A | A |
| Embedding | | A | A | A | B | A | A | B | B | B |
| Yellowing of medium | | B | A | A | A | A | A | A | A | A |
| Damage to medium | | B | A | A | A | A | A | A | A | A |

| | | Example 10 | Example 11 | Example 12 | Example 13 | Example 14 | Example 15 | Example 16 | Comparative Example 1 | Comparative Example 2 |
|---|---|---|---|---|---|---|---|---|---|---|
| Formation of plasma | | Line type | Line type | Line type | Line type | Line type | Line type | Line type | Line type | Direct type |
| Apparatus | (B) mm | 4 | 4 | 4 | 4 | 4 | 0.5 | 21 | — | — |
| Plasma source | $N_2$ | — | 97 | 97 | 97 | 97 | 97 | 97 | Plasma irradiation is not performed | — |
| | $O_2$ | 3 | 3 | 3 | 3 | 3 | 3 | 3 | — | — |
| | Ar | 97 | — | — | — | — | — | — | — | — |
| Number of plasma irradiation | | 2 | 1 | 2 | 3 | 4 | 2 | 2 | 2 | 2 |
| Banding unevenness | | A | B | A | A | A | A | A | C | A |
| Embedding | | B | B | A | A | A | A | C | D | A |
| Yellowing of medium | | A | A | A | A | A | C | A | A | D |
| Damage to medium | | A | A | A | A | A | C | A | A | D |

Banding

Whether or not there is color heterogeneity due to banding unevenness (the striped pattern) was determined by visual observation. The evaluation criteria were as follows. The evaluation results are shown in Table 1.

A: The banding unevenness is not generated.

B: The banding unevenness is generated in some parts but cannot be visually confirmed.

C: The banding unevenness is generated in some parts and is visually confirmed.

D: The banding unevenness is generated in the entire printed portion and is visually confirmed.

Embedding

When observing a printed portion unit a duty of 80% by using a microscope (200 times), the ink embedding was determined by the rate that a base is visible. The evaluation criteria were as follows. The evaluation results are shown in Table 1.

A: The base is completely coated with ink.

B: The base is not coated, and an exposed part is less than 10%.

C: The base is not coated, and an exposed part is less than 20% and equal to or greater than 10%.

D: The base is not coated, and an exposed part is equal to or greater than 20%.

Yellowing of Medium

The printing is performed under the conditions shown in Table 1, and then the b* value of a non-printed portion of the medium is evaluated by comparing a case before performing the printing with a case after performing the printing evaluation. The evaluation criteria are as follows. The evaluation results are shown in Table 1.

A: The rate of variability of b* is lower than 5%.

B: The rate of variability of b* is equal to or greater than 5% and less than 10%.

C: The rate of variability of b* is equal to or greater than 10% and lower than 15%.

D: The rate of variability of b* is equal to or greater than 15%.

Damage to Recording Medium

The printing was performed for five hours under the conditions illustrated in Table 1, and the evaluation was performed based on the evaluation criteria below. The evaluation results are shown in Table 1.

A: The paper jam is not generated, or a roller trace does not remain.

B: The paper jam is generated about once, or the roller trace remains in some cases.

C: The paper jam is generated about two or three times, or the roller trace remains in some cases.

D: The paper jam is generated four times or more, or the roller trace remains in some cases.

As illustrated in Table 1, in Examples 1 to 16, the banding unevenness can be reduced and thus the ink embedding is preferable compared with Comparative Example 1 in which the plasma is not emitted. In addition, in Examples 1 to 16, it was possible to suppress the damage to or the discoloration (yellowing) of the medium further than in Comparative Example 2 which employs the direct method.

In addition, from the comparison between Example 15 and Example 1 and the comparison between Example 1 and Example 2, it is understood that the discoloration (yellowing) of the medium can be suppressed when the distance (B) between the medium 2 and the plasma irradiation port 25 of the plasma irradiation mechanism 20 is preferably equal to or greater than 1 mm, and is more preferably equal to or greater than 3 mm.

In addition, from the comparison between Example 16 and Example 4, and the comparison between Example 4 and Example 3, it is understood that it is possible to improve a surface modifying effect of the medium 2 by the plasma irradiation and thus the ink embedding can be improved when the distance (B) between the medium 2 and the plasma irradiation port 25 of the plasma irradiation mechanism 20 is preferably equal to or less than 20 mm, and is more preferably equal to or less than 7 mm.

In addition, from the comparison between Example 11 and Example 12, it is understood that it is possible to improve a surface modifying effect of the medium 2 by the plasma irradiation when emitting the plasma two or more times before attaching the ink with respect to the one portion on the medium. That is, the banding unevenness can be reduced, and thus the ink embedding can be improved.

Further, from the comparison between Example 5 and Example 6, it is understood that a case of using the line-type plasma irradiation mechanism can make the region irradiated with the plasma uniform unlike the case of using the spot type, and thus it is possible to suppress banding unevenness.

In addition, in this embodiment, when comparing Examples 7 and 9 with Example 6, the ink embedding in a case of using a mixed gas of $N_2$ and $O_2$ can be improved more than that in a case of using a single gas of Ar or $N_2$. From this, it is understood that the life of radicals and a bonding method of the functional group are changed according to the gas type, and thus the level of the surface modification becomes different. Meanwhile, since the mixed gas of $N_2$ and $O_2$ can be produced by using an apparatus for taking out the nitrogen from the air (by membrane separation), it is possible to reduce the usage of consumables such as gas cylinders.

The entire disclosure of Japanese Patent Application Nos. 2014-009514, filed Jan. 22, 2014, 2014-033116, filed Feb. 24, 2014, and 2014-069910, filed Mar. 28, 2014 are expressly incorporated by reference herein.

What is claimed is:

1. An ink jet printer comprising:

a transport mechanism that transports a medium in a first direction; and a carriage that includes:

a plasma irradiation mechanism, which emits plasma generated by applying a voltage to a gas in a discharge portion from a plasma irradiation port and then irradiates at least a part of the medium with the plasma;

a gas supply chamber that is in a longitudinal shape extending in an extending direction, the discharge portion being provided at an inside of the gas supply chamber, the gas being supplied into the inside of the gas supply chamber;

an exhaust member that exhausts and discharges the gas, the exhaust member being located on an outer surface of the gas supply chamber and extending along the outer surface of the gas supply chamber in the extending direction; and a head which ejects ink to the part of the medium which is irradiated with the plasma, and that moves in a second direction intersecting with the first direction, wherein the plasma irradiation mechanism is provided on one side of the head in the second direction, and wherein the discharge portion of the plasma irradiation mechanism is disposed so as not to come in contact with the medium.

2. The ink jet printer according to claim 1, wherein a distance between the medium and the plasma irradiation port of the plasma irradiation mechanism is 1 mm or more and 20 mm or less.

3. The ink jet printer according to claim 2, wherein the distance between the medium and the plasma irradiation port of the plasma irradiation mechanism is 3 mm or more and 7 mm or less.

4. The ink jet printer according to claim 1, wherein the carriage is configured so that one portion on the medium is irradiated with the plasma at least twice before the ink is attached to the medium.

5. An ink jet printer comprising:

a transport mechanism that transports a medium in a first direction; and a carriage that includes:

first and second irradiation mechanisms, each of the first and second irradiation mechanisms emitting plasma generated by applying a voltage to a gas in a discharge portion from a plasma irradiation port and then irradiates at least a part of the medium with the plasma;

first and second gas supply chambers, each of the first and second gas supply chambers being in a longitudinal shape extending in an extending direction, the discharge portion being provided at an inside of each of the first and second gas supply chambers, the gas being supplied into the inside of each of the first and second gas supply chambers;

first and second exhaust members that are respectively located on first and second outer surfaces of the first and second gas supply chambers and that extend along the first and second outer surfaces of the first and second gas supply chambers in the extending direction, each of the first and second exhaust members exhausting and discharging the gas; and a head which ejects ink to the part of the medium which is irradiated with the plasma, and that moves in a second direction intersecting with the first direction, wherein the first and second plasma irradiation mechanisms are provided on both sides of the head in the second direction, and wherein the discharge portion of each of the first and second plasma irradiation mechanisms is disposed so as not to come in contact with the medium.

6. The ink jet printer according to claim 5, wherein a distance between the medium and the plasma irradiation port of each of the first and second plasma irradiation mechanisms is 1 mm or more and 20 mm or less.

7. The ink jet printer according to claim 6, wherein the distance between the medium and the plasma irradiation port of each of the first and second plasma irradiation mechanisms is 3 mm or more and 7 mm or less.

8. The ink jet printer according to claim 5, wherein the carriage is configured so that one portion on the medium is irradiated with the plasma at least twice before the ink is attached to the medium.

9. A printing method of performing printing on a medium which is transported in a first direction by using a carriage which includes a plasma irradiation mechanism emitting plasma generated by applying a voltage to a gas in a discharge portion from a plasma irradiation port, a gas supply chamber that is in a longitudinal shape extending in an extending direction an exhaust member exhausting and discharging the gas, and a head ejecting ink, wherein the discharge portion is provided at an inside of the gas supply chamber, the gas is supplied into the inside of the gas supply chamber, the exhaust member is located on an outer surface of the gas supply chamber and extends along the outer surface of the gas supply chamber in the extending direction, the method comprising:

emitting the plasma, which is generated in the discharge portion of the plasma irradiation mechanism, from the plasma irradiation port so as to irradiate at least a part of the medium with the plasma;

exhausting and discharging the gas by the exhaust member; and ejecting the ink from the head to the part of the medium which is irradiated with the plasma, wherein in the emitting of the plasma and the ejecting of the ink, the printing is performed by transporting the carriage in a second direction intersecting with the first direction, wherein in the emitting of the plasma, due to the plasma irradiation mechanism which is provided on one side of the head in the second direction, the plasma is emitted in a state where the discharge portion does not come in contact with the medium.

10. The printing method according to claim 9, wherein a distance between the medium and the plasma irradiation port of the plasma irradiation mechanism is 1 mm or more and 20 mm or less.

11. The printing method according to claim 10, wherein a distance between the medium and the plasma irradiation port of the plasma irradiation mechanism is 3 mm or more and 7 mm or less.

12. The printing method according to claim 9, wherein one portion on the medium is irradiated with the plasma at least twice before the ink is attached to the medium.

13. A printing method of performing printing on a medium which is transported in a first direction by using a carriage, the carriage includes:

first and second irradiation mechanisms, each of the first and second irradiation mechanisms emitting plasma generated by applying a voltage to a gas in a discharge portion from a plasma irradiation port;

first and second gas supply chambers, each of the first and second gas supply chambers being in a longitudinal shape extending in an extending direction, the discharge portion being provided at an inside of each of the first and second gas supply chambers, the gas being supplied into the inside of each of the first and second gas supply chambers;

first and second exhaust members that are respectively located on first and second outer surfaces of the first and second gas supply chambers and that extend along the first and second outer surfaces of the first and second gas supply chambers in the extending direction, each of the first and second exhaust members exhausting and discharging the gas; and a head which ejects ink, the method comprising:

transporting the medium in the first direction;

emitting the plasma, which is generated in the discharge portion of each of the first and second plasma irradiation mechanisms, from the plasma irradiation port so as to irradiate at least a part of the medium with the plasma;

exhausting and discharging the gas by the first and second exhaust members; and ejecting the ink from the head to the part of the medium which is irradiated with the plasma, wherein during the emitting of the plasma and the ejecting of the ink, the printing is performed by transporting the carriage in a second direction intersecting with the first direction, wherein during the emitting of the plasma, due to the first and second plasma irradiation mechanisms which are provided on both sides of the head in the second direction, the plasma is emitted in a state where the discharge portion does not come in contact with the medium, when the carriage moves in a first way in the second direction, the plasma is emitted only from the first plasma irradiation mechanism so that the ink is ejected from the head after the plasma is emitted from the first plasma irradiation mechanism, and when the carriage moves in a second way opposite to the first way in the second direction, the plasma is emitted only from the second plasma irradiation mechanism so that the ink is ejected from the head after the plasma is emitted from the second plasma irradiation mechanism.

14. The printing method according to claim 13, wherein a distance between the medium and the plasma irradiation port of each of the first and second plasma irradiation mechanisms is 1 mm or more and 20 mm or less.

15. The printing method according to claim 14, wherein the distance between the medium and the plasma irradiation port of each of the first and second plasma irradiation mechanisms is 3 mm or more and 7 mm or less.

16. The printing method according to claim 13, wherein one portion on the medium is irradiated with the plasma at least twice before the ink is attached to the medium.

* * * * *